US006574929B2

(12) United States Patent
Wildenhain et al.

(10) Patent No.: US 6,574,929 B2
(45) **Date of Patent: *Jun. 10, 2003**

(54) FIRE-RESISTANT ELEMENT FOR THE CLOSURE OF A ROOM

(75) Inventors: Klaus Wildenhain, Düsseldorf (DE); Ralf Linden, Aachen (DE)

(73) Assignee: Vetrotech Saint-Gobain (International) AG, Walchwill (CH)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/396,788

(22) Filed: Sep. 15, 1999

(65) Prior Publication Data

US 2002/0043034 A1 Apr. 18, 2002

(30) Foreign Application Priority Data

Sep. 16, 1998 (DE) ..... 198 42 327

(51) Int. Cl.[7] ..... E04C 2/00
(52) U.S. Cl. ..... 52/232; 52/1; 52/573.1
(58) Field of Search ..... 52/232, 573.1, 52/1, 208, 202, 203; 49/62, 61, 465, 466, 463

(56) References Cited

U.S. PATENT DOCUMENTS

| | | | | |
|---|---|---|---|---|
| 3,915,777 A | * | 10/1975 | Kaplan | 52/232 X |
| 4,178,728 A | | 12/1979 | Ortmanns et al. | |
| 4,204,374 A | * | 5/1980 | Olson | 52/208 |
| 4,601,143 A | * | 7/1986 | O'Keefe et al. | |
| 4,750,303 A | * | 6/1988 | Mullen | 52/1 X |
| 5,509,241 A | * | 4/1996 | Coconis et al. | 52/232 |
| 5,735,098 A | * | 4/1998 | Kanai et al. | 52/232 X |
| 5,799,456 A | * | 9/1998 | Shreiner | 52/573.1 X |
| 6,079,162 A | * | 6/2000 | Hein | 52/1 |

FOREIGN PATENT DOCUMENTS

| | | | |
|---|---|---|---|
| DE | 23 44 459 A1 | | 4/1975 |
| DE | 23 28 737 B2 | | 10/1975 |
| DE | 25 27 134 A1 | | 12/1976 |
| DE | 26 54 776 C2 | | 12/1978 |
| DE | 3508078 | * | 9/1986 |
| DE | 37 25 853 A1 | | 2/1989 |
| DE | 3927653 | * | 3/1991 |
| DE | 44 17 496 C2 | | 11/1995 |
| DE | 197 10 289 C1 | | 5/1998 |
| EP | 201212 | * | 11/1986 |
| EP | 0 590 978 A1 | | 4/1994 |
| EP | 0 658 677 B1 | | 6/1995 |
| EP | 0 663 507 A2 | | 7/1995 |
| FR | 2145304 | * | 2/1973 |
| GB | 2 289 496 A | | 11/1995 |
| WO | WO 94/04355 | | 3/1994 |
| WO | WO 99/04970 | | 2/1999 |

* cited by examiner

*Primary Examiner*—Lanna Mai
*Assistant Examiner*—Hanh V. Tran
(74) *Attorney, Agent, or Firm*—Pennie & Edmonds LLP

(57) ABSTRACT

A fire-resistant wall (2) has a window consisting of a fire window (1). The fire window (1) is a monolithic or laminate with the properties of a safety glass. At its end faces (4), it is immediately contiguous with an adjacent construction wall part, with the formation of a narrow joint. It is supported by supporting arms (15), via fasteners (7) which are introduced into holes (6) in the pane (1). The fasteners (7) are provided with articulations (11, 12) which follow the bowing of the pane (1) in the event of a fire.

17 Claims, 3 Drawing Sheets

FIRE-RESISTANT ELEMENT FOR THE CLOSURE OF A ROOM

BACKGROUND OF THE INVENTION

The present invention relates to a fire-resistant wall comprising at least one fire window, which is directly contiguous via its end faces with one face of an adjacent part of a construction wall, with the formation of a narrow joint, and which is fastened using fasteners placed on supporting arms and passing through holes made in the fire window.

Although the panes in a fire-resistant wall are usually fastened at their edges in a suitable frame, Patent EP 0,658,677 B1 teaches a construction wall structure in which multilayer fire windows, composed of several sheets of glass or panes and of layers of foaming material which expand with heat, these layers being placed between the sheets of glass or panes, are fastened, using clamping fixtures placed in the corners, by means of supporting arms to a support placed some distance from the fire window. If the adjacent parts of the construction wall are also composed of such fire windows, it is possible to produce in this way fire-resistant walls in entirely glazed constructions having an aesthetically pleasing appearance. The necessary sealing of the joints in the event of a fire, in order to prevent propagation of the fire and of the smoke, is then ensured, or alternatively enhanced, by the foaming mass emerging via the end faces of the multilayer fire windows.

In this known fire-resistant construction wall, the mass which is placed between the various panes of the multilayer fire windows and which foams in the event of a fire, forms a heat shield which greatly reduces the heat transfer through the fire window. In the event of a fire, that pane exposed to the fire in the stack of panes breaks as a general rule under the effect of the thermal stresses which are generated. On the other hand, that pane on the opposite side from the fire is heated markedly less and reaches temperatures of at most approximately 180° C. It essentially retains its plane shape and expands in all cases in its plane under the effect of the heat. With known multilayer windows, having foaming interlayers, a bowing of the fire window can thereby occur only if the panes are assembled in a fixed manner to the support by means of fasteners and if the support and the pane expand very differently in the event of a fire. In order to prevent such a situation, the supporting arms carrying the fasteners are attached to the support so as to be able to slide along the support, thus preventing the panes from bowing.

A fire-resistant element for the closure of a room of this known type is relatively expensive because of the complicated structure of the multilayer fire windows which have an effective heat shield made of a foaming material between the panes.

SUMMARY OF THE INVENTION

On the other hand, the object of the invention is to develop a fire-resistant wall or construction wall, of the type mentioned in the introduction, in which more simply constructed fire windows can be used.

The fire-resistant wall in accordance with the invention is characterized in that the fire window is a pane without an interlayer capable of foaming, and in that the fasteners are attached to the supporting arms in a moveable or articulated manner such that they follow any bowing of the pane occurring in the event of a fire.

Unlike the known fire-resistant walls of the type mentioned in the introduction, which have multilayer fire windows, the physical conditions pertaining to the panes without a foaming interlayer, which is effective as a heat shield, are fundamentally different in the event of a fire. Whereas actually in the known multilayer windows the pane exposed to the fire breaks because of the thermal expansion and of the stresses resulting therefrom which act in the surface, thereby eliminating the compressive stresses on that side, the compressive stresses remain in their entirety in the hot face, for example in monolithic panes, as long as the fire window is fulfilling its function of a closure element of the room. However, this necessarily results, at least temporarily, in the pane bowing quite markedly, since that face of the pane which is on the opposite side from the fire is always at a lower temperature than the face exposed to the fire, because of the latter's radiation and of the convection effect. At the present time, in order to prevent additional mechanical stresses due to the fasteners, under which additional stresses the mechanical strength of the pane, already subjected to high stresses, may easily be exceeded, the fasteners and/or the means for fastening them have, in accordance with the invention, a deformable structure and they adapt to any variation in the position of the pane, due to the bowing, at the respective fastening point.

It is certainly the case, according to a known principle, that it may be advantageous for the fire windows to be exposed uniformly, right to their edges, to the effect of the heat. However, the solutions known hitherto for obtaining uniform heating of the pane exclusively involve special frame constructions which are, for example, described in the publications DE 2,328,737 B2, DE 2,344,459 C3, DE 2,527,134 B2 and DE 2,654,776 C2.

The fire window may be of the monolithic type, having a pane which is constructed in such a way that, in the event of a fire, on the one hand it does not break under the effect of the stresses which are generated and on the other hand it has a softening temperature high enough not to become separated from its support. For this purpose, thermally prestressed (toughened or tempered) panes having the properties of monolithic safety glass are particularly used.

In this regard, it has proved particularly advantageous to use, for this purpose, panes having properties such as those described in Patent DE 19,710,289 C1. These panes of silicate glass are characterized in that they have a thermal expansion coefficient $\alpha_{20-300}$ of 6 to $8.5\times10^{-6}$ $K^{-1}$, a thermal stress factor $\phi$ of 0.5 to 0.8 N/(mm$^2$.K), a softening point (viscosity=$10^{7.6}$ dPa.s) of 750° to 830° C. and a forming point or working point (viscosity=$10^4$ dPa.s) of at most 1210° C., preferably at most 1190° C. The thermal stress factor $\phi$ is the quantity, specific to the glass, which is calculated from the thermal expansion coefficient $\alpha$, the elastic modulus E and the Poisson's ratio $\mu$ by the formula $\phi=\alpha E/(1-\mu)$.

Of course, it is also possible to use, as fire windows, laminated windows consisting of at least two individual sheets of glass or panes which have been thermally prestressed or have been thermally prestressed partially and which have been assembled by means of the usual interlayers, especially of the polyvinyl butyral (PVB) type, not constituting a heat shield.

The individual panes of these laminated windows advantageously have thermal-expansion, softening, thermal-stress and working characteristics fulfilling the above conditions.

The pane of the fire window forming the wall according to the invention may advantageously be provided, at least on one side, with a layer that reflects the thermal radiation, this layer being advantageously deposited by pyrolytic deposition.

If, in a fire-resistant construction wall in accordance with the invention, the pane is for example fixed only in the corners by discrete supports, it may suffice, in the case of small sizes, for the discrete supports solidly prestressed with the pane to be provided with a ball joint or to be fastened to a ball joint, which allows the discrete support to undergo a pivoting movement in any direction. If, particularly in the case of larger sizes, the panes are held in their corners and furthermore also at points located between them, these intermediate fasteners must be made in such a way that they are supported so as to be able to move to some extent in the direction perpendicular to the surface of the pane, these intermediate fasteners being furthermore preferably supported in a pivoting manner.

In another advantageous embodiment of the invention, the materials filling the joints between the end faces of the pane and the adjacent parts of the construction walls are composed of heat-resistant substances which deform or expand in a manner such that the joints, which move and in certain cases enlarge as a consequence of the bowing of the pane, remain hermetically sealed throughout the period of resistance of the pane to the fire.

In this regard, it turns out that, for example, silicone rubbers crosslinking at high temperature, having a Shore A hardness of 40 to 60, as well as extruded beads composed of or using substances which foam under the effect of heat, namely, in particular, salts, which form, under the effect of heat, readily volatile substances such as water vapour, ammonia, carbon dioxide, etc., are very suitable for this use. The use of such substances as well as of certain adhesives which become ceramics at high temperature in order to close off the joints in fire-resistant construction walls is, in principle, known. It has also turned out that silicone sealing strips which are firmly bonded on one side, in a heat-resistant manner, to the end face of a pane and which bear against the opposite side, solely as a mechanical link, because of the shape and the friction force, to the end face of the adjacent part of the construction wall, and which slide along this face, while remaining hermetically applied thereto, throughout the bowing operation of the pane, are also very suitable.

Examples of substances that foam under the effect of heat may be found especially in WO-A-94/04355, WO-A-99/04970 or EP-A-590,978.

BRIEF DESCRIPTION OF THE DRAWINGS

The invention will be described in greater detail below, with reference to the appended drawings which illustrate two embodiments, in which drawings.

DETAILED DESCRIPTION OF THE DRAWINGS

Figure 1:
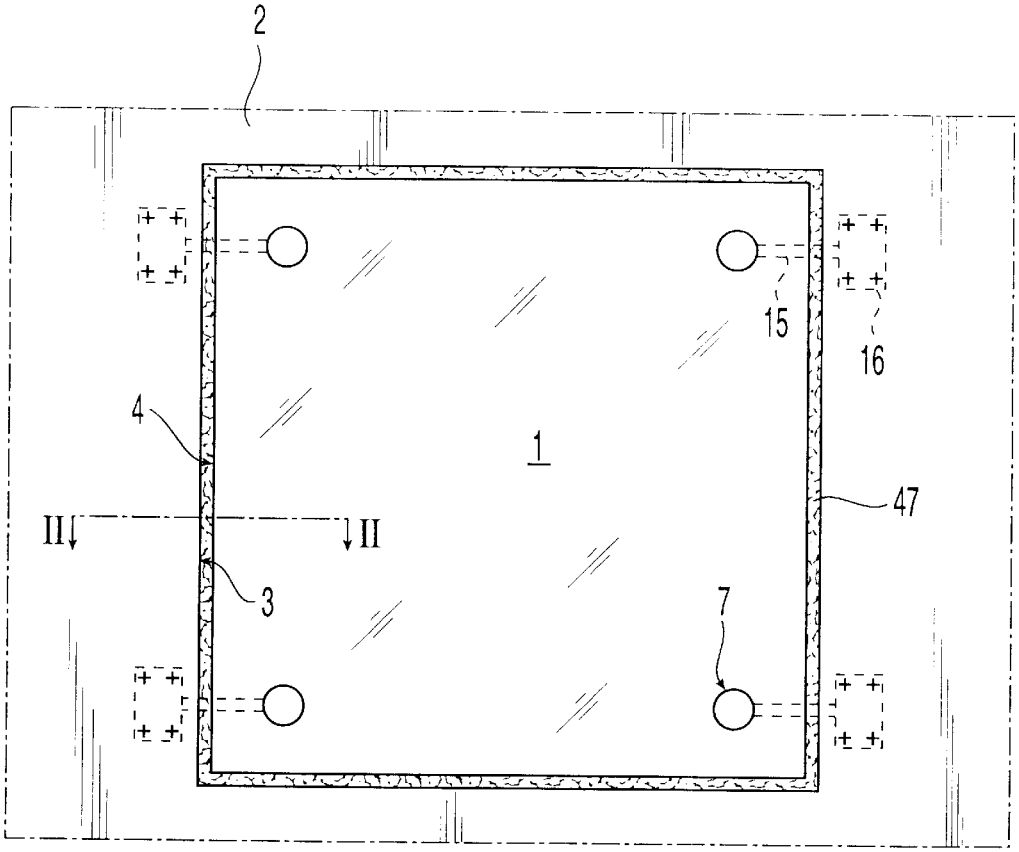
FIG. 1 shows a portion of a fire-resistant construction wall having a fire window fitted into a window opening, seen from the front.
Figure 2:
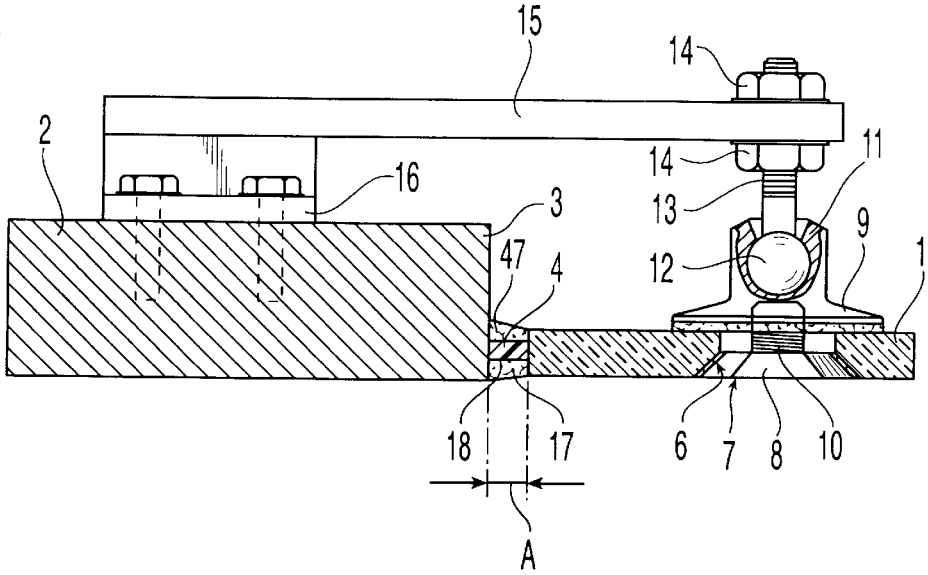
FIG. 2 illustrates a cross section along the line II—II of FIG. 1, on a larger scale.

In the embodiment illustrated in FIGS. 1 and 2, the approximately square fire window 1 is placed in the corresponding window opening of a fire-resistant construction wall element 2. The internal limiting face of the window opening, that is to say the reveal 3 of the window, forms a plane face and presents no frame structure for housing the fire window 1. Rather, the end faces 4 of the fire window 1 terminate at a distance A from the reveal of the window and form a groove which is filled with a fire-resistant sealing agent.

The fire window 1 is a fire-resistant monolithic pane, of the fire-resistance class G according to the DIN 4102 standard, or alternatively the ISO/DIS 834-1 standard. In this regard, it may, for example, be a pane of standard thermally toughened float glass. However, particularly well suited for this use are glasses having a higher softening point than standard float glass, of the order of 800° C., a thermal expansion coefficient $\alpha_{20-300}$ of 6.5 to $7.5\times10^{-6}$ $K^{-1}$ and a thermal stress factor $\phi$ of 0.6 to 0.7 N/($mm^2$.K). Glasses of this type offer the advantage that, on the one hand, they have a longer period of resistance to the fire test, because of their higher softening point, but that, on the other hand, they may be prestressed using standard toughening plants, in such a way that they also exhibit, in the prestressed state, the properties of a standard monolithic safety glass in addition to their particular aptitude in the event of a fire. Of course, glasses having other compositions may also be used for this application provided that they have a softening temperature of suitable value.

The pane 1 is provided in each of its corners with a hole 6. Fastened in each hole is a clamping device 7. The latter basically comprises an outer clamping plate 6 and an inner clamping plate 9 which are clamped, one against the other, by means of a screw 10. The resilient interlayers between the clamping plates and the pane are obviously composed of heat-resistant incombustible substances, for which, for example, silicone rubber interlayers that are difficult to burn are very well suited. Joined to the inner clamping plate 9 is a ball-joint socket 11 in which the ball 12 is housed. The ball 12 is placed at the end of a threaded rod 13 which in turn is rigidly fastened to the supporting arm 15 using two nuts 14. The supporting arm 15 is fastened to the construction wall element 2 via support pads 16.

Given that the clamping fastening 7 is supported by means of the ball joint 11, 12, it is able, in the case of the pane 1 bowing, to pivot through a certain angle in any direction, in such a way that no large additional flexural load is transferred to the pane on this occasion by the clamping fastening. Of course, it is also possible to use other constructions for the articulated assembly of the clamping device with the supporting arm.

The joints between the end faces 4 of the pane 1 and the reveal 3 are closed off with a silicone rubber 17 of durable elasticity, it being possible for the sealing to be achieved both by a special silicone-wetting finish (silicone mastic) and by a suitable silicone sealing strip or, where appropriate, also by suitable metal extrusions. A combination of a silicone sealing strip and a mastic has thus proved to be advantageous, a silicone sealing strip being bonded on one side to the end face of the pane using a silicone adhesive, while the sealing strip bears via the other side to the reveal 3, without the slightest bonding. In this way, the sealing effect of the silicone sealing strip is also maintained when the pane bows under the effect of heat, given that the silicone sealing strip follows the movement of the pane.

Figure 2A:
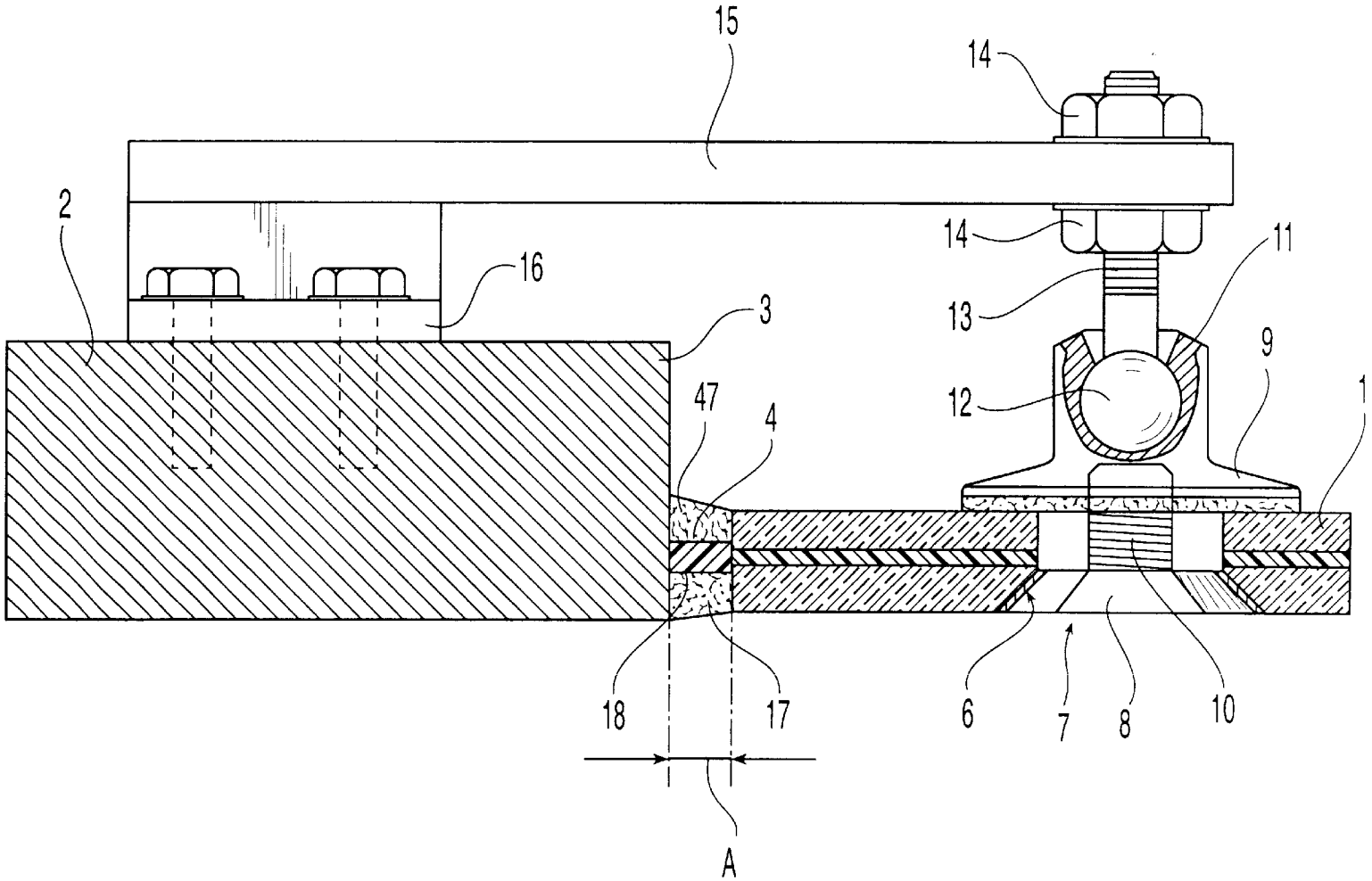
FIG. 2A illustrates the cross section of FIG. 2 for an alternate embodiment of the fire window.

In the embodiment illustrated in FIG. 2, an extruded bead 18 of a substance which expands as a foam under the effect of heat is placed between the silicone sealing masses 17. At the temperatures at which the pane bows, the extruded bead 18 expands and thus seals sufficiently well against the reveal 3 in the event of a change in the position of the edge of the pane. As can be sen in FIG. 2A, in an alternate embodiment, the fire window is a laminated window.

Figure 3:
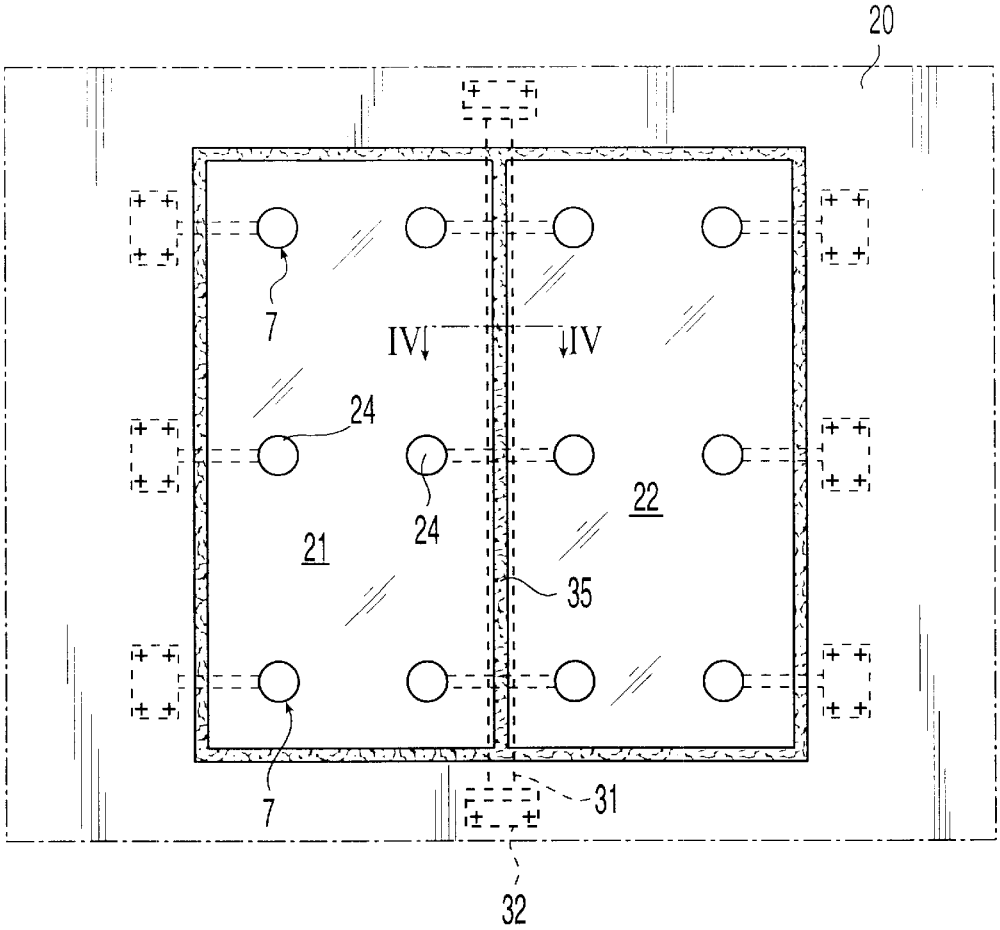
FIG. 3 shows a portion of a fire-resistant construction wall having two fire windows mounted edge to edge, one against the other, seen from the front.
Figure 4:
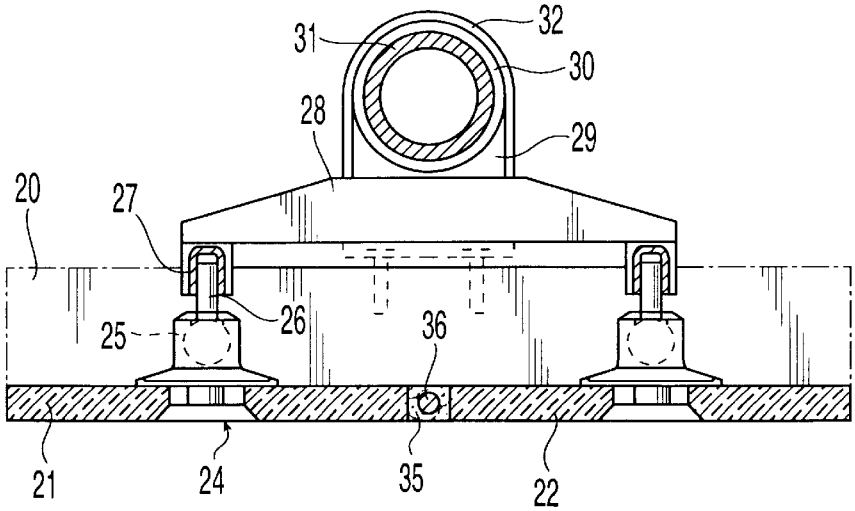
FIG. 4 illustrates a cross section along the line IV—IV of FIG. 3, shown on a larger scale.

Illustrated in FIGS. 3 and 4 is a glazed wall of large area within a construction wall structure 20 which surrounds it. The glazed wall is formed by two fire-resistant panes 21, 22 which are placed edge to edge, separated from each other by a seal. The two panes 21, 22 are held exclusively by clamping devices 7, 24 which correspond to the clamping devices described in relation to FIG. 2.

Although the clamping devices 7 placed in the corners of the panes 21, 22 are each supported so that they can execute only a pivoting movement, the clamping devices 24 placed in the middle of the panes are designed so that they are able to execute an additional movement in the direction perpendicular to the pane. For this purpose, the rods 26 connected to the ball 25 are, as FIG. 4 shows, supported so as to be able to slide in guide bushes 27. The guide bushes 27 are placed rigidly on a supporting arm 28. Joined to the supporting arm 28 via a junction piece 29 is a sliding ring 30 which can slide in the axial direction along the cylindrical support 31. In this way, the different thermal expansions of the support 31 and of the panes may be accommodated. The support 31 is fastened to the construction wall structure 20 by brackets 32.

Just like the butt joints between the end faces of the panes and the reveal of the construction wall, the joint between the end faces opposite each other of the two panes 21 and 22 is closed off by a suitable silicone seal 35. Placed in the mass of silicone is an extruded bead 36 made of an inorganic substance which foams under the effect of the heat. At the high temperatures at which the silicone rubber has already decomposed, the foaming mass provides the sealing effect and thus prevents the fire and smoke propagating through the joints.

It also falls within the scope of the invention, in a fire-resistant wall comprising several fire windows, for example in an arrangement corresponding to FIG. 3 of two panes placed end to end, one against the other, to support the panes by discrete fasteners only along the edges placed against each other, but to mount them, in a known manner, in a standard frame structure along the edges contiguous with the construction wall structure.

Fire tests on windows corresponding to those described in the embodiments have shown that the panes withstand more than 30 minutes exposure to fire and therefore correspond to the fire-resistance class G30.

List of Numerical References

1 Fire window
2 Wall element
3 Window reveal
4 End face
6 Hole
7 Clamping fastening
8 Clamping plate
9 Inner clamping plate
10 Screw
11 Ball socket
12 Ball
13 Threaded rod
14 Nut
15 Supporting arm
16 Support pad
17 Sealing of the pane
18 Extruded bead
20 Construction wall structure
21 Pane
22 Pane
24 Clamping fastening
25 Ball
26 Rod
27 Guide bush
28 Supporting arm
29 Junction piece
30 Sliding ring
31 Support
32 Bracket
35 Silicone seal
36 Extruded bead
A distance

What is claimed is:

1. In a fire-resistant wall comprising at least one fire-resistant window having at least one end face which is directly contiguous with one face of an adjacent part of a construction wall, a narrow sealed joint formed between the at least one end face and the construction wall, and a plurality of supporting arms extending from the construction wall, each supporting arm with a fastening structure having a first end rigidly attached thereto, and a second end passing through a hole made in the window, wherein the window (1, 21, 22) is a pane free from a foamable interlayer and each fastening structure includes an intermediate portion ranged in a movable manner such that said intermediate portion allows the fastening structure to follow any bowing of the pane (1, 21, 22) occurring in the event of a fire.

2. In a fire-resistant wall according to claim 1, wherein the fire-resistant window (1, 21, 22) is a monolithic pane.

3. In a fire-resistant wall according to claim 1, wherein the fire-resistant window (1, 21, 22) is a laminated window.

4. In a fire-resistant wall according to claim 2 or 3, wherein each pane is a prestressed pane having the properties of safety glass.

5. In a fire-resistant wall according to claim 4, wherein the fire-resistant window (1, 21, 22) is composed of a silicate glass with a softening point (viscosity=$10^{7.6}$ dPa.s) of 750° to 830° C., a working point (viscosity=$10^4$ dPa.s) of at most 1190° C., a thermal expansion coefficient $\alpha$(20–300) of 6 to $8.5\times10^{-6}$ $K^{-1}$ and a thermal stress factor $\phi$ of 0.5 to 0.8 N/($mm^2$.K).

6. In a fire-resistant wall according to claim 1, wherein the fasteners (7, 24) are provided with clamping means (8, 9) holding the pane (1, 21, 22) in place and with an articulation (11, 12) which allows the pane (1, 21, 22) to undergo a pivoting movement.

7. In a fire-resistant wall according to claim 1, wherein the fasteners (24) allow movement, perpendicular to the surface of the pane, between the pane (21, 22) and a corresponding supporting arm (28).

8. In a fire-resistant wall according to claim 1, wherein the joint is sealed off by a silicone rubber seal combined with an extruded bead (18, 36) made of an inorganic substance which expands as a foam under the effect of the heat.

9. In a fire-resistant wall according to claim 1, wherein the joint is sealed off by silicone sealing strips which are bonded via one side to the end face of the pane using a fire-resistant adhesive and bear via the opposite side as a mechanical link against the end face of the adjacent construction wall.

10. In a fire-resistant wall according to claim 1, wherein the pane (1, 21, 22) is provided, at least on one side, with a layer that reflects the thermal radiation, this layer being deposited by pyrolytic deposition.

11. In a fire-resistant wall according to claim 1, wherein the fire-resistant wall further comprising a glazed wall formed of at least two fire-resistant panes positioned edge to edge and connected by a sealed joint.

12. In a fire-resistant wall according to claim 1, wherein the fire-resistant window is composed of a fire-resistant class G glass according to DIN 4102 standard.

13. In a fire-resistant wall comprising at least one fire-resistant window having at least one end face which is directly contiguous with one face of an adjacent part of a construction wall, a narrow sealed joint formed between the at least one end face and the construction wall, and a plurality of supporting arms extending from the construction wall, each supporting arm with a fastener attached thereto which is fastened to the window, the fasteners passing through holes made in the window, the improvement wherein the window (1, 21, 22) is a pane free from a foamable interlayer and the fasteners (7, 24) are attached to the supporting arms (15, 28) in a movable manner such that they follow any bowing of the pane (1, 21, 22) occurring in the event of a fire, and wherein the fasteners (24) allow movement, perpendicular to the surface of the pane, between the pane (21, 22) and a corresponding supporting arm (28), and wherein the fasteners (24) are provided with a guide rod (26) which is supported so as to bear in a sliding manner in a guide bush (27) placed on the supporting arm (28).

14. In a fire-resistant wall comprising at least one fire-resistant window having at least one end face which is directly contiguous with one face of an adjacent part of a construction wall, a narrow sealed joint formed between the at least one end face and the construction wall, wherein the joint is sealed by a material composed of a heat resistance substance which deforms or expands under the effect of heat, and a plurality of supporting arms extending from the construction wall, each supporting arm with a fastening structure having a first end rigidly attached thereto, and a second end passing through a hole made in the window, wherein the window is a pane free from a foamable interlayer and each fastening structure includes an intermediate portion arranged in a movable manner such that said intermediate portion allows the fastening structure to follow any bowing of the pane occurring in the event of a fire.

15. In a fire-resistant wall according to claim 14, wherein the joint is sealed off by a silicone rubber seal combined with an extruded bead made of an inorganic substance which expands as a foam under the effect of the heat.

16. In a fire-resistant wall according to claim 14, wherein the joint remains hermetically sealed throughout a period of resistance of the pane to fire.

17. In a fire-resistant wall according to claim 14, wherein the material remains attached to an edge of the pane throughout a period of resistance of the pane to fire.

* * * * *

UNITED STATES PATENT AND TRADEMARK OFFICE

CERTIFICATE OF CORRECTION

PATENT NO. : 6,574,929 B2
DATED : June 10, 2003
INVENTOR(S) : Wildenhain et al.

It is certified that error appears in the above-identified patent and that said Letters Patent is hereby corrected as shown below:

Column 6,
Line 26, replace "ranged" with -- arranged --.

Signed and Sealed this

Fifteenth Day of July, 2003

JAMES E. ROGAN
*Director of the United States Patent and Trademark Office*